United States Patent [19]

Fielder, Jr.

[11] Patent Number: 4,494,593

[45] Date of Patent: Jan. 22, 1985

[54] VENETIAN BLIND ASSEMBLY WITH IMPROVED LADDER SUPPORTING TILT DRUMS

[75] Inventor: William V. B. Fielder, Jr., Westminister, Md.

[73] Assignee: Roper Corporation, Kankakee, Ill.

[21] Appl. No.: 481,288

[22] Filed: Apr. 1, 1983

[51] Int. Cl.[3] ..... E06B 9/322; E06B 9/326

[52] U.S. Cl. ..... 160/177

[58] Field of Search ..... 160/177, 166, 173, 174, 160/175, 176, 178 R, 178 B, 178 C, 178 E, 178 F, 170; 24/129 R, 130

[56] References Cited

U.S. PATENT DOCUMENTS

| | | | |
|---|---|---|---|
| 2,162,226 | 6/1939 | McKinney | 160/178 F |
| 2,918,968 | 12/1959 | Schultz | 160/177 |
| 3,289,739 | 12/1966 | Hensel | 160/176 |
| 3,333,905 | 8/1967 | Hennequin | 160/177 X |
| 3,443,624 | 5/1969 | Toth | 160/107 |
| 3,605,852 | 9/1971 | Vechiarelli | 160/168 |
| 3,918,513 | 11/1975 | England et al. | 160/176 |
| 4,177,853 | 12/1979 | Anderson et al. | 160/168 |
| 4,200,135 | 4/1980 | Hennequin | 160/168 |

FOREIGN PATENT DOCUMENTS

| | | | |
|---|---|---|---|
| 2805469 | 8/1978 | Fed. Rep. of Germany | 160/177 |
| 549710 | of 1956 | Italy | 160/173 |

*Primary Examiner*—Peter M. Caun
*Assistant Examiner*—Cherney S. Lieberman
*Attorney, Agent, or Firm*—Leydig, Voit, Osann, Mayer & Holt, Ltd.

[57] ABSTRACT

A venetian blind assembly having rotatably mounted tilt drums which are adapted to permit properly aligned and indexed mounting of respective slat ladders without the necessity for time consuming measurements and without the need for auxiliary fasteners. Each ladder has an uppermost rung disposed about an underside of a respective tilt drum with portions of the ladder side cords adjacent said uppermost rung extending over the drum in crossing relationship and then downwardly along opposite sides of the drum with the slat supporting rungs suspended below the drum. The drum includes first integrally formed ladder engaging constrictions cooperating with the uppermost ladder rung for indexing the rung in relatively precise position on the drum and for securing the ladder in such index position, and second ladder engaging constrictions in axially spaced relation to the first ladder engaging restrictions for retaining the downwardly extending side cord portions in proper position with respect to the drum, whereby the upper rung and adjacent side cord portions are wrapped about the drum approximately $1\frac{1}{2}$ turns and secured in such assembled position during tilting movement of the drum.

20 Claims, 13 Drawing Figures

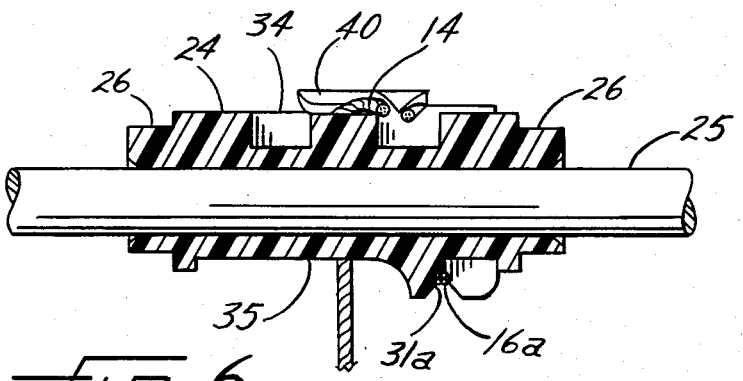
Fig. 6.
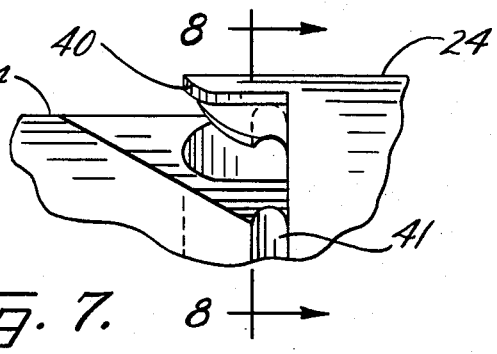
Fig. 7.
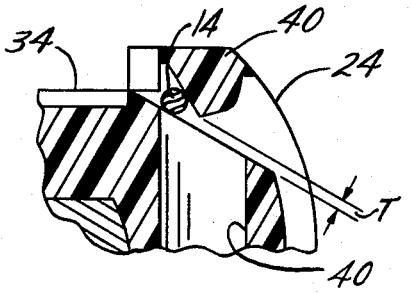
Fig. 8.
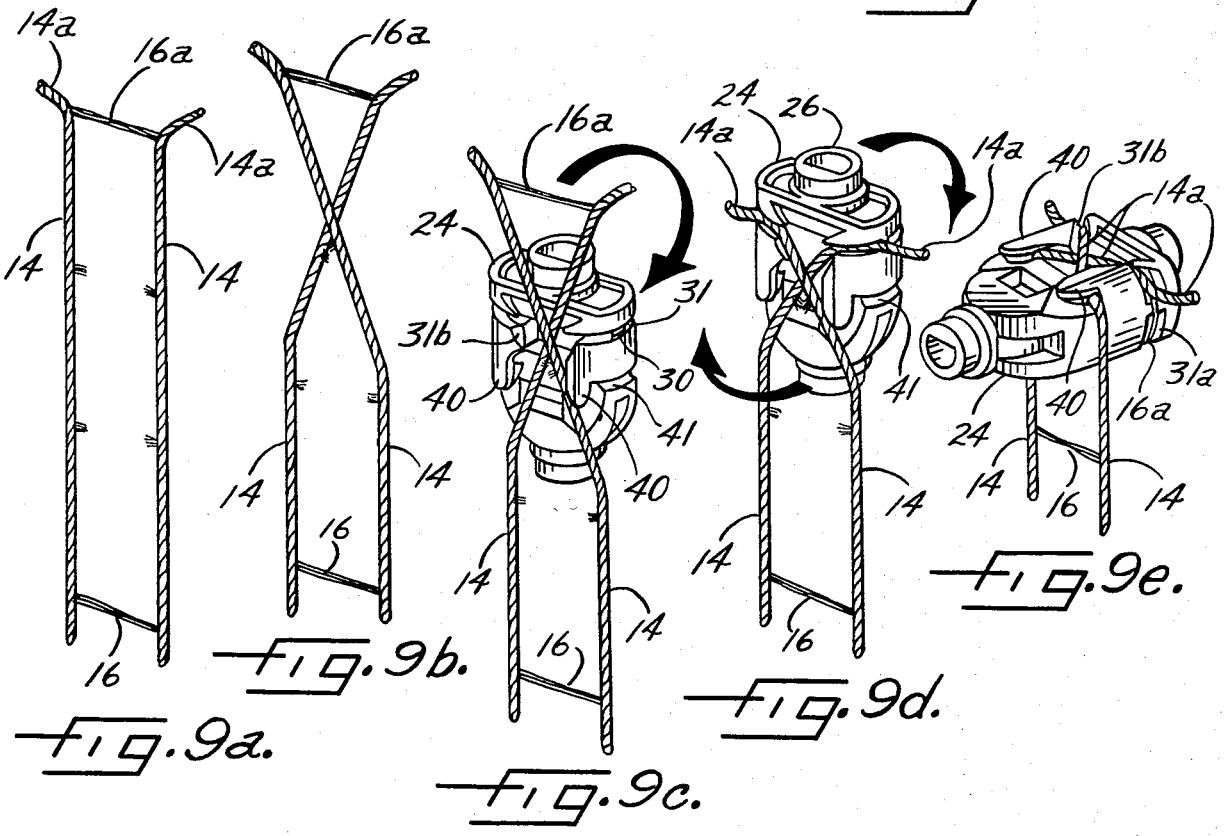
Fig. 9a.
Fig. 9b.
Fig. 9c.
Fig. 9d.
Fig. 9e.

VENETIAN BLIND ASSEMBLY WITH IMPROVED LADDER SUPPORTING TILT DRUMS

DESCRIPTION OF THE INVENTION

The present invention relates generally to venetian blinds, and more particularly, to rotatable drum devices for supporting and tilting slat supporting ladders of such venetian blinds.

Venetian blinds typically comprise a plurality of horizontal slats suspended beneath a wall mounted head rail by at least two slat ladders. The ladders customarily are suspended from a rod or respective tilt drums rotatably mounted in the head rail so as to permit synchronized movement of the ladders and controlled tilting of the slats. The slat ladders generally each comprise a pair of side cords interconnected by a plurality of vertically spaced slat supporting rungs, and each ladder must be carefully mounted or assembled on its respective tilt drum so that the ladder rungs support and tilt the slats at the same angle. Heretofore, the mounting of slat ladders has created problems, often requiring considerable labor to obtain proper alignment, and in some instances, requiring reworking if the ladders are hung in a misaligned or uneven condition.

One method of facilitating proper alignment of the slat supporting rungs of the ladders has been to establish determined ladder attachment points, such as by measuring a predetermined distance from the first ladder rung, and then securing the ladder at such attachment points to determined locations on the tilt drum. For example, knots may be tied in the upper ends of the ladder side cords at the desired attachment points to facilitate such mounting. Alternatively, ferrules or other fasteners may be secured to the ladder side cords at equal distance locations above the first rung. Such procedures require the time consuming and sometimes difficult pre-assembly steps of accurately measuring the ladder attachment points and then physically altering the ladder to make it suitable for proper mounting on the tilt drum.

It is an object of the present invention to provide a venetian blind with tilt drums that permit properly aligned and indexed mounting of slat ladders without the necessity for measurements and without the need for auxillary fasteners or the like.

Another object is to provide a venetian blind with tilt drums as characterized above that permit easy mounting of the slat ladders in predetermined alignment and reliably maintain such alignment during use.

A further object is to provide a venetian blind with tilt drums of the foregoing type which have a relatively simple, unitary construction.

Still another object is to provide an improved method of accurately assemblying a venetian blind slat ladder on a supporting tilt drum.

Other objects and advantages of the invention will become apparent upon reading the following detailed description and upon reference to the drawings, in which.

Figure 2:
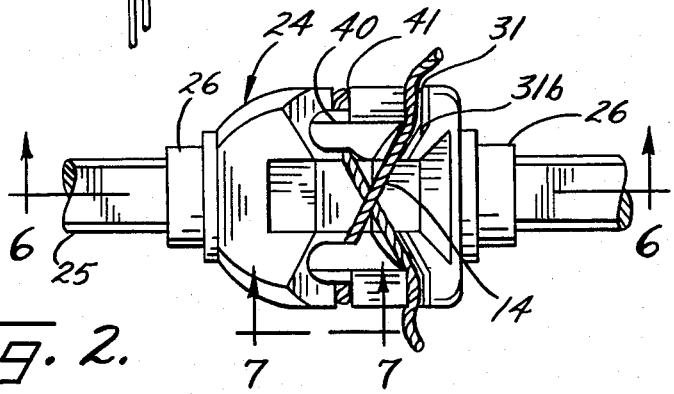
FIG. 2 is an enlarged top view of one of the tilt drums of the venetian blind assembly shown in FIG. 1.
Figure 3:
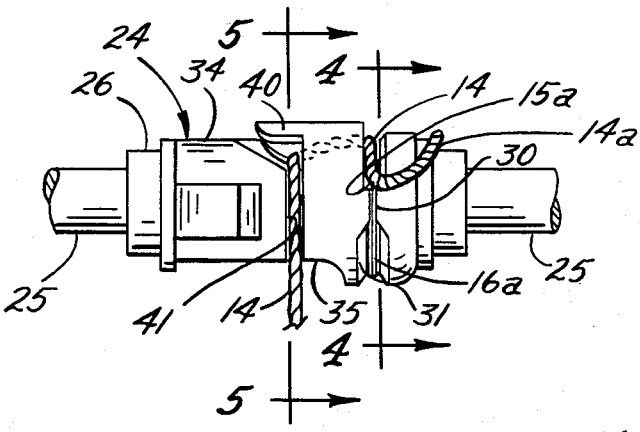
FIG. 3 is a side elevation view of the tilt drum shown in FIG. 2.
Figure 4:
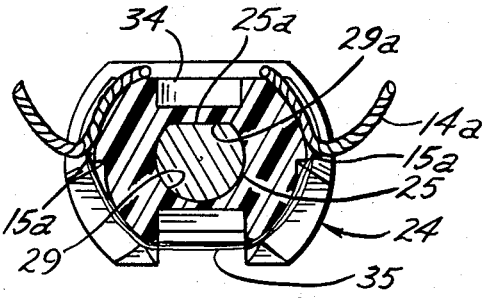
Figure 5:
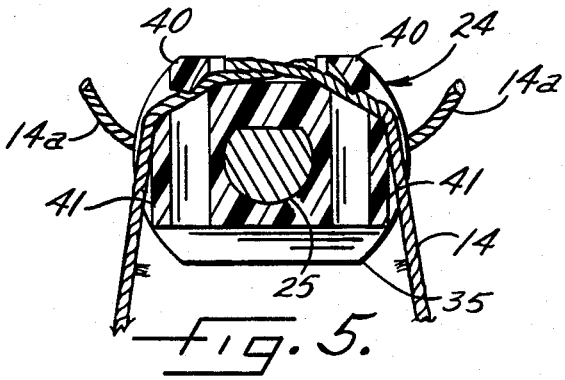

FIGS. 4 and 5 are enlarged vertical sections of the illustrated tilt drum taken in the planes of lines 4—4 and 5—5, respectively, in FIG. 3;

FIG. 6 is a vertical section of the illustrated tilt drum taken in the plane of line 6—6 in FIG. 2;

FIG. 7 is an enlarged view of one of the ladder side cord retaining tabs of the illustrated tilt drum with the ladder removed;

FIG. 8 is a vertical section taken in the plane of line 8—8 in FIG. 7 but showing the ladder retained therein; and FIGS. *9a–9e* are sequential views illustrating the method of assembling a slat ladder to the illustrated tilt drum.

While the invention is susceptible of various modifications and alternative constructions, a certain preferred embodiment has been shown in the drawings and will be described below in detail. It should be understood, however, that there is no intention to limit the invention to the specific form described but, on the contrary, the intention is to cover all modifications, alternative constructions and equivalents falling within the scope of the appended claims.

Figure 1:
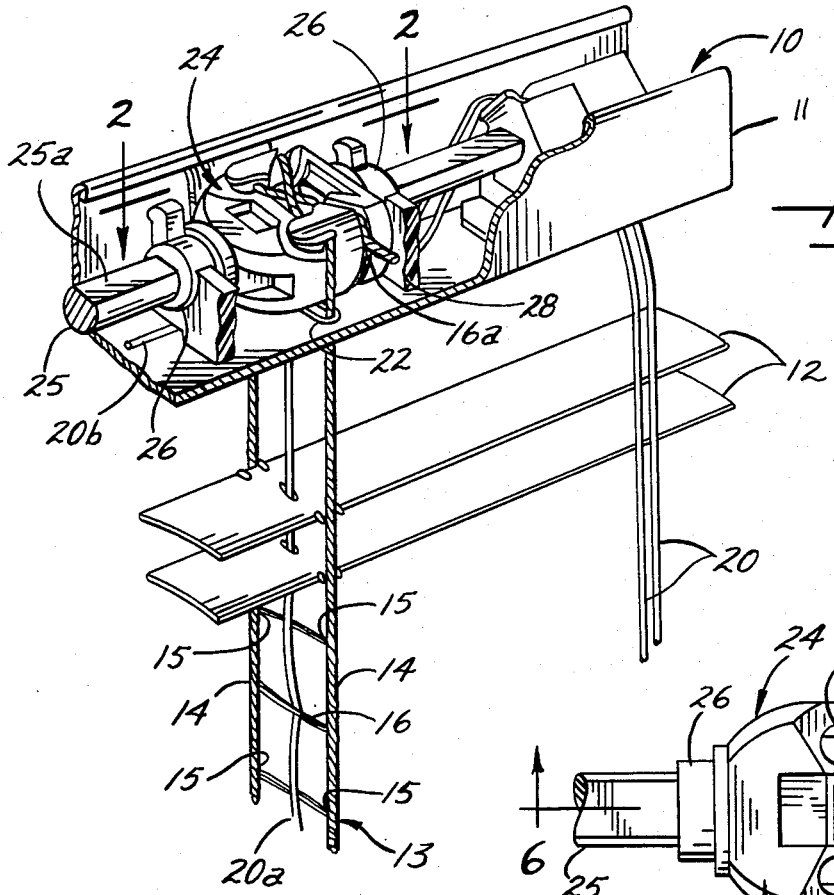
FIG. 1 is a perspective view of part of a venetian blind assembly having slat ladder supporting tilt durms embodying the present invention.

Referring now to FIG. 1 of the drawings, there is shown an illustrative venetian blind assembly 10 which includes a wall mounted head rail 11 and a customary array of horizontal slats 12 suspended below the head rail 11 by ladders 13 (only one of which is shown). The head rail 11 in this case is an upwardly opening metal channel member. The ladders 13 also are of a conventional type, in this instance each including parallel flexible side cords 14 interconnected at regularly vertically spaced locations flexible rungs 16 which join the side cords at junction points or nodes, designated 15. The lowermost ends of the ladder side cords 14 are secured to an appropriate bottom rail (not shown) in the usual manner, and the slats 12 are inserted between the side cords 14 of each ladder and are horizontally supported by corresponding rungs 16 of two ladders at locations intermediate the ends of the slats.

In order to raise the ladders 13 and the slats 12 supported thereon, a lift cord 20 of a known type is provided. The lift cord 20 has its opposite ends *20a, 20b* secured to the bottom rail of the venetian blind at the locations of the ladders 13 and each end is trained upwardly through the slats 12 between the ladder side cords 14 in interleaved fashion with the rungs 16, through the bottom of the head rail 11, along the length of the head rail and through a locking device 21 of a known type mounted at the end of the head rail. A central portion of the lift cord 20 then depends from the locking device 21 and through the head rail 11 for manual operation in raising and lowering the blind.

For suspending each ladder 13 from the head rail 11, an upper end of the ladder extends through an access slot 22 in the bottom of the head rail and is secured to a tilt drum 24, which in turn is mounted on a rotatable shaft 25. The tilt drum 24 preferably is a one piece molded plastic body formed with opposed axial extensions 26 which are journaled in brackets 28, preferably also made of plastic, mounted in upstanding relation on the bottom of the head rail 11. For angularly orienting each drum 24 in proper position on the shaft 25 and for permitting a driving connection between the shaft and tilt drum, the shaft 25 is formed with a flat *25a* that cooperates with a similarly formed flat *29a* in an axial mounting bore 29 of the drum. As in known in the art, a wand or cord may be operatively connected to an end of the shaft 25 to permit manual rotation of the shaft, and thus rotation of the tilt drums 24 mounted thereon, for raising and lowering the side cords 14 of each ladder 13 relative to each other, which in turn simultaneously tilts the ladder rungs 16 and slats 12 in common directions.

In accordance with the invention, each tilt drum has integrally formed means located at circumferentially spaced locations on the drum corresponding to the length of a ladder rung for automatically locating the ladder in predetermined position on the tilt drum during assembly without the necessity for measurement and for retaining the ladder in such position during use without the need for auxiliary fasteners. To this end, each tilt drum 24 is formed with first ladder engaging constrictions 30 located at circumferentially spaced locations, as measured about the underside of the drum, corresponding in length to the ladder rungs 16 for receiving and engaging the opposed ends of the uppermost ladder rung, designated 16*a*, with the cord junction points or nodes 15*a* thereof, designated 15*a*, held immediately adjacent the upper end of the constrictions 30. The constrictions 30 preferably are centrally located in first ladder receiving grooves 31 formed in opposite peripheral sides of the drum. The illustrated drum 24 is formed with generally flattened upper and lower surfaces 34, 35, as best shown in FIGS. 4 and 5, and the first ladder receiving grooves 31 are formed in opposed arcuate side portions of the drum and are interconnected on the underside of the drum by a groove 31*a*.

In the illustrated embodiment, the uppermost rung 16*a* of the ladder is positioned about the underside of the drum 24 with the rung 16*a* being disposed in the first peripheral grooves 31, 31*a* and the nodes 15*a* of the uppermost rung 16*a* tautly disposed against the constrictions 30, as shown in FIG. 3. The ladder side cords 14 immediately adjacent the uppermost rung 16*a* extend upwardly and over the drum 24 in crossing relation (FIG. 2) and then downwardly adjacent the sides of the drum in depending fashion (FIG. 3) such that the ladder is in effect wrapped around and encompasses the tilt drum 1½ turns. The grooves 31 in the arcuate sides of the drum each communicate with a laterally angled groove 31*b* formed in the upper flat surface 34, which directs the ladder side cords 14 from the side grooves 31 into crossing rotation at a point laterally offset from the grooves 31. It will be seen that the groove constrictions 30 properly locate the nodes 15*a* of the uppermost rung 16*a* in position on the drum such that when the drum is horizontally positioned, as shown in FIG. 1; the rungs 16 and the slats 12 supported thereon are horizontally disposed in relatively precise predetermined alignment. The opposed sides of each groove constriction 30 preferably are formed with a lateral spacing slightly less than the thickness of the rung 16*a* such that the rung can be snapped through the constriction and thereafter positively retained in place. The ladder side cords 14 preferably have a greater thickness than the rungs 16 such that the nodes 15*a* of the uppermost rung are restricted from being pulled through the constrictions 30.

In keeping with the invention, each tilt drum 24 has second integrally formed ladder engaging means, in this case in the form of tabs 40 located in axial spaced relation to the first ladder engaging constrictions 30, for facilitating reliable retention of the ladder 13 in assembled form on the drum and for supporting the ladder in relatively precise alignment with the head rail access slot 22 through which the ladder is suspended. The retaining tabs 40 preferably are located at opposite sides of the upper flattened drum surface 34 immediately over a pair of second arcuate ladder receiving grooves 41, formed in parallel axially spaced relation to the first ladder receiving grooves 31. The illustrated retaining tabs 40 are oriented in an axial direction away from the first ladder engaging constrictions 30 such that following crossing of the ladder side cords 14 on top of the drum, the side cords each may be hooked and rigidly clamped under a respective one of the retaining tabs 40, with the depending portions of the side cords received and retained in the second grooves 41, which in turn are disposed in predetermined relation over the access slot 22 in the head rail 11. The retaining tabs 40, like the first ladder engaging constrictions 30, are formed with a ladder cord receiving access opening "t" which is less than the thickness of the side cords, as shown in FIG. 8, such that the side cords must be forced under the tabs 40 and are thereafter positively retained in place.

It will be appreciated that, depending upon the vertical spacing between the rungs 16, during assembly of the ladder 13 on the tilt drum 24, one or more of the rungs 16 immediately below the uppermost rung 16*a* may be cut away to provide a sufficiently long loop at the upper end of the ladder, as defined by the uppermost rung 16*a* and the immediate adjacent side cords 14, for wrapping the ladder about the drum in the foregoing manner. In the illustrated embodiment, the two rungs immediately below the uppermost rung 16*a* are cut away. The untrimmed upper ends 14*a* of the side cords above the uppermost rung 16*a* remaining after cutting of the ladder to desired size for assembly will not impede tilting of the drum.

A method of attaching the slat ladder 13 to the tilt drum 24 in accordance with the present invention is illustrated in FIGS. 9*a*–9*e*. A length of ladder may be unwound from an appropriate spool (not shown) and cut to length by cutting the side cords 14 at a point between two ladder rungs 16, thereby leaving an uppermost rung 16*a* with free end portions 14*a* of a length approximately half the distance between the ladder rungs. In the illustrated embodiment, the two ladder rungs 16 below the uppermost rung 16*a* are cut away, as shown in FIG. 9*a*, to provide sufficient clearance for assemblying the ladder on the tilt drum. The uppermost rung 16*a* may then be rotated to form a cross between the upper portions of the side cords 14. The crossing side cords are then positioned on the upper flat surface 34 of the tilt drum, as shown in FIG. 9*c*, so that the loop formed by the uppermost rung 16*a* and the immediately adjacent side cords 14 may be positioned about the arcuate grooves 31, 31*a* with the nodes 15*a* of the uppermost rung 16*a* located immediately above and tightly against the constrictions 30, thereby locating the ladder 13 in properly aligned position on the tilt drum. The crossing side cords 14 may then be forced under the retaining tabs 40 to secure the ladder in assembled form on the tilt drum, as shown in FIG. 9*e*, which then may be assembled on the support shaft 25 for mounting in the head rail 11. It will appreciated that alternately the uppermost rung 16*a* may be positioned under the tilt drum about the grooves 31, 31*a* with the opposed ends thereof engaged by the constrictions 30, the ladder then rotated to cross the ladder side cords over the top of the drum, and the ladder side cords then positioned into the retaining tabs 40 as described previously.

It will be seen that upon rotation of the shaft 25, the ladder supporting tilt drums 24 are rotated in unison with the shaft, such that commonly disposed ladder side cords 14 of each ladder are raised while the opposite side cords are lowered, thus causing simultaneous tilting of all the ladder rungs 16 and the slats 12 supported thereon in a common direction. During such tilting movement in either direction, the ladders 13 are retained in predetermined assembled position on their respective tilt drum 24, and in proper depending relation through the respective access slots 22 in the head rail 11, by the cooperation of the first ladder engaging constrictions 30 with the nodes 15*a* of the uppermost rung 16*a* of each ladder, the one and one-half turn wrap of the ladder about the tilt drum, and the retaining tabs 40.

From the foregoing, therefore, it can be seen that the venetian blind tilt drum of the present invention is adapted to automatically align a slat ladder in proper orientation during assembly without requiring time consuming or difficult measurements and without the need for auxiliary fasteners. The tilt drum also permits relatively easy assembly of the slat ladders and positively maintains the precise ladder alignment during use of the blind. Moreover, it will be appreciated that the tilt drum has a relatively simple, unitary construction. For example, the tilt drum has a symmetrical configuration about a vertical axial plane so as to lend itself to relatively inexpensive plastic molding.

What is claimed is:

1. In a venetian blind assembly having a plurality of slats pivotably supported by flexible ladders, said ladders each having a pair of side cords with a plurality of slat supporting rungs connected between said side cords at vertically spaced junction nodes, a head rail rotatably supporting a tilt shaft, and a plurality of tilt drums mounted on said shaft for supporting said ladders, wherein the improvement comprises: said tilt drums each having a one piece body with integrally formed means cooperating with the nodes of the uppermost rung of the ladder for indexing the nodes in relatively precise predetermined positions on the tilt drum and for securing the ladder in such position during tilting drum movement.

2. In the assembly of claim 1 in which said ladder rungs are sized less than said ladder side cords, said ladder indexing and securing means including a pair of ladder engaging constrictions formed in said body and having a circumferential spacing about said body corresponding to the length of said uppermost rung, and said constrictions being sized to receive the ends of the upper most ladder rung while restricting entry of the nodes thereof such that said upper most rung is tautly secured about said body.

3. In the assembly of claim 1 in which said ladder indexing and securing means includes a pair of ladder engaging constrictions integrally formed in said body and having a circumferential spacing about said body corresponding to the length of said uppermost rung, whereby said constrictions receive opposite ends of said uppermost rung with the nodes thereof held closely adjacent said constrictions.

4. In the assembly of claim 3 in which said constrictions are disposed on opposite sides of said drum and have a circumferential spacing, as measured about the underside of said drum, corresponding to the length of said uppermost rung, and said uppermost rung is disposed about the underside of said drum with the nodes thereof disposed adjacent upper sides of said constrictions.

5. In the assembly of claim 3 in which said ladder rungs are sized less than said ladder side cords, and said constrictions are sized to receive the ends of said uppermost ladder rung while restricting entry of the nodes thereof.

6. In the assembly of claim 3 in which said body is formed with first peripheral grooves for receiving said uppermost ladder rung secured by said constrictions.

7. In the assembly of claim 1 in which said uppermost ladder rung is disposed about an underside of said body and the adjacent portions of said side cords extend upwardly over said body and then downwardly adjacent opposite sides of said body with lower slat supporting rungs of the ladder suspended beneath said body, whereby said uppermost rung and adjacent ladder side cord portions are wrapped approximately 1½ times around said body.

8. In the assembly of claim 7 in which said adjacent side cord portions extend over said body and cross each other at a point in axially spaced relation to said constrictions.

9. In the assembly of claim 7 in which said body has a pair of second integrally formed ladder engaging constrictions for respectively receiving the downwardly extending side cord portions and retaining said side cord portions in place against said drum during tilting movement thereof.

10. In the assembly of claim 9 in which said second ladder engaging constrictions include a pair of tabs about which side cord portions are positively hooked.

11. In the assembly of claim 10 in which said side cord receiving tabs are oriented in a lateral direction away from said first ladder engaging constrictions.

12. In the assembly of claim 9 in which said drum body has first peripheral grooves for receiving said ladder rung and adjacent side cord portions secured by said first ladder engaging constrictions, and second peripheral grooves for receiving the ladder side cords secured by said second ladder engaging constrictions.

13. In the assembly of claim 12 in which said first peripheral grooves are formed on opposed sides of said body and communicate at their upper ends with respective laterally angled grooves for directing said side cords into crossing relationship on top of said body.

14. In a venetian blind assembly having a plurality of slats pivotably supported by flexible ladders, said ladders each having a pair of side cords with a plurality of slat supporting rungs connected between said side cords at vertically spaced junction nodes, a head rail rotatably supporting a tilt shaft, and a plurality of tilt drums mounted on said shaft for supporting said ladders, wherein the improvement comprises: said tilt drums each having a one piece body construction, said ladder having an uppermost rung disposed about an underside of said body with the portions of the side cords adjacent said uppermost rung extending over said body in crossing relationship and then downwardly along opposite sides of said body with slat supporting rungs suspended below said body, said body having first integrally formed ladder engaging means cooperating with said uppermost ladder rung for indexing said rung in relatively precise predetermined position on said drum and for securing the ladder in such indexed position, and said body having second integrally formed ladder engaging means in axially spaced relation to said first ladder engaging means for retaining said downwardly extending side cord portions in proper position with respect to said body, whereby said uppermost rung and adjacent side cord portions are wrapped about said body approxiately 1½ turns and are retained in such positions during tilting movement of said drum.

15. In the assembly of claim 14 in which said first ladder engaging means comprises a pair of constrictions having a circumferential spacing about said body corresponding to the length of said uppermost rung, whereby said constrictions receive opposite ends of said uppermost rung with the nodes thereof held closely adjacent said constrictions.

16. In the assembly of claim 15 in which said second ladder engaging means includes a pair of side cord engaging constrictions disposed on said body in axial space relation to said first ladder engaging constrictions.

17. In the assembly of claim 16 in which said first ladder engaging constrictions are disposed on opposed sides of said drum body.

18. In the assembly of claim 14 in which said drum body has first peripheral grooves for receiving said uppermost ladder run and adjacent side cord portions secured by said first ladder engaging means, and said body has second peripheral grooves for receiving the ladder side cord portions secured by said second ladder engaging means.

19. A method of assemblying a slat ladder having a pair of side cords with vertically spaced slat supporting rungs therebetween to a tilt drum of a venetian blind, the tilt drum having first ladder engaging means on opposed sides thereof and second ladder engaging means located in axially spaced relation thereto, said method comprising the steps of positioning the uppermost rung of said ladder about the underside of said drum, indexing and securing said uppermost ladder rung between said first ladder engaging means, rotating said ladder to cross the portions of said side cords adjacent said uppermost rung at a point in axially spaced relation to said first ladder engaging means, securing the side cords by said second laddering engaging means, and suspending said ladder in depending relation from said second ladder engaging means.

20. The method of claim 19 including cutting away at least one rung of said ladder just below said uppermost ladder rung to form a sufficient sized loop, as defined by said uppermost rung and adjacent side cords, for assembly on said drum.

* * * * *